US007028509B2

(12) United States Patent
Mitchell et al.

(10) Patent No.: US 7,028,509 B2
(45) Date of Patent: Apr. 18, 2006

(54) TWO-PLY BLANK AND A METHOD OF MANUFACTURING A CIRCULARLY KNITTED TWO-PLY BLANK

(75) Inventors: John Mitchell, Asheboro, NC (US); Heinz Altman, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/903,884

(22) Filed: Jul. 30, 2004

(65) Prior Publication Data

US 2006/0021388 A1 Feb. 2, 2006

(51) Int. Cl.
*A41B 9/00* (2006.01)

(52) U.S. Cl. ..... 66/176; 66/196

(58) Field of Classification Search ..... 66/171, 66/176, 172 E, 170, 177; 450/75, 156
See application file for complete search history.

(56) References Cited

U.S. PATENT DOCUMENTS

| | | | | |
|---|---|---|---|---|
| 709,734 | A | 9/1902 | Bellis | |
| 3,307,379 | A | 3/1967 | Woolley et al. | |
| 3,561,219 | A | 2/1971 | Nishizawa et al. | |
| 3,656,323 | A | 4/1972 | Brown | |
| 4,047,400 | A | 9/1977 | Thorneburg | |
| 4,341,096 | A | 7/1982 | Safrit et al. | |
| 4,467,626 | A | 8/1984 | Coble et al. | |
| 5,172,571 | A | 12/1992 | Gariboldi | |
| 5,373,713 | A | 12/1994 | Miller | 66/196 |
| 5,675,992 | A | 10/1997 | Wrightenberry | |
| 5,787,503 | A | 8/1998 | Murphy, III | |
| 5,850,745 | A | 12/1998 | Albright | |
| 5,907,960 | A | 6/1999 | Lonati et al. | |
| 5,946,944 | A | 9/1999 | Osborne | |
| 6,105,401 | A | 8/2000 | Chadeyron et al. | |
| 6,287,168 | B1 | 9/2001 | Rabinowicz | |
| 6,612,136 | B1 | 9/2003 | Roe | |
| 6,622,312 | B1 | 9/2003 | Rabinowicz | |
| 6,645,040 | B1 | 11/2003 | Rabinowicz et al. | |
| 6,645,041 | B1 | 11/2003 | Sørensen | |
| 6,779,367 | B1 * | 8/2004 | Mitchell et al. | 66/176 |

(Continued)

FOREIGN PATENT DOCUMENTS

| | | |
|---|---|---|
| FR | 002783532 | 3/2000 |
| FR | 002792006 | 10/2000 |
| GB | 2 342 846 A | 4/2000 |

(Continued)

*Primary Examiner*—Danny Worrell
(74) *Attorney, Agent, or Firm*—Ohlandt, Greeley, Ruggiero & Perle, L.L.P.

(57) ABSTRACT

A circularly knitted garment and a method of making a circularly knitted garment are provided. The garment has a cylindrical layer of fabric having an inner layer having a first free-end and a first edge, an outer layer having a second free-end and a second edge and a junction to join the first edge to the second edge. The second free-end is connected to the first free-end and the second edge is connected to the first edge during the knitting process to form a completed two-ply garment. The method provides turning the second series of courses outside of the first series of courses while the second series of courses is joined by held loops to the first series of courses at a junction. The method further includes knitting a second free-end to a first-free end using held loops from the second series of courses to form a completed two-ply garment.

31 Claims, 5 Drawing Sheets

U.S. PATENT DOCUMENTS

| | | | |
|---|---|---|---|
| 2001/0039816 | A1 | 11/2001 | Fujiwara et al. |
| 2003/0010067 | A1 | 1/2003 | Okamoto |
| 2003/0010069 | A1 | 1/2003 | Okamoto |
| 2003/0019252 | A1 | 1/2003 | Sciacca |
| 2003/0097860 | A1 | 5/2003 | Sciacca |

FOREIGN PATENT DOCUMENTS

| | | |
|---|---|---|
| JP | 401239013 | 9/1989 |
| JP | 02002371403 | 12/2002 |
| JP | 02003193302 | 7/2003 |

* cited by examiner

TWO-PLY BLANK AND A METHOD OF MANUFACTURING A CIRCULARLY KNITTED TWO-PLY BLANK

BACKGROUND OF THE INVENTION

1. Field of the Invention

The present invention is related to circular knitted garments. More particularly, the present invention is related to circularly knitted garments having integral loops connecting layers of such garments. Still more particularly, the present invention relates to circularly knitted garments having integral loops connecting layers of such garments to form completed garments prior to removal from a knitting machine.

2. Description of Related Art

Circular knitting processes are commonly used in the manufacture of many wearable clothing articles. Circular knitting processes can be carried out on commercially available machines for such purposes including for example, the SANTONI Top 2 (SM 88 Top 2), the SANTONI Top or the Brescia EV04 circular knitting machine. Such machines have found widespread usage in the manufacture of tubular garments, such as brassieres, pantyhose, underwear, hosiery, socks, sweaters and other similar garments.

Improvements in circular knitting methods have greatly increased the production speeds of knitted garments and have also provided a wide choice of patterns for the knitted garments. While improvements have been achieved, operators still must handle the knitted blank, typically in the form of a long cylinder, to finish the production of the garment. This additional handling by an operator increases the overall production costs of the finished garment. When a blank for a brassiere or a pair of underwear is removed from a circular knitting machine, the operator must handle the blank by, for example, folding one layer inside the other layer to create a two-ply garment. Further, the operator also must connect the blank plies and make appropriate cut out areas in the blank to finish the garment.

The method of manufacturing a blank can be improved by minimizing the steps during manufacturing of the garment. Also, garment production can be expedited by making a blank that is closer to completion prior to exiting the circular knitting machine. Specifically, time and cost savings can be achieved by completing some manufacturing steps during formation of the blank.

Accordingly, there is a need for circularly knitted blanks that are completed or substantially completed prior to exiting the circular knitting machine and a method for knitting such blanks to reduce manufacturing time, operator handling time and the associated costs.

SUMMARY OF THE INVENTION

It is an object of the present invention to provide a circularly knitted two-ply blank that is completed prior to exiting a circular knitting machine.

It is another object of the present invention to provide a circularly knitted garment having two plies that are integrally connected at their free ends by held loops extending from one of plies the prior to the garment exiting the knitting machine.

It is yet another object of the present invention to provide a circularly knitted garment having two plies that are selectively connected by loops extending from one of the plies, prior to exiting the knitting machine.

It is still another object of the present invention to provide a circularly knitted two-ply garment that requires minimal and/or efficient handling by an operator to finish the garment.

It is a further object of the present invention to provide an improved process for knitting blanks on a circular knitting machine that minimizes steps in the manufacturing process.

It is still a further object of the present invention to provide an improved process for knitting blanks on a circular knitting machine that incorporates the formation of the blank into the knitting process.

These and other objects and advantages of the present invention are achieved by a circularly knitted garment having a first series of courses providing an inner layer having a first free-end and a first edge, and a second series of courses providing an outer layer having a second free-end and a second edge, such that the first edge and the second edge are joined by a connector. A plurality of loops join the first free-end to the second free-end and the first edge to the second edge at the connector to form a completed garment.

A method of making a circularly knitted blank is also provided. The method provides knitting a generally cylindrical first series of courses having a first free-end and knitting a generally cylindrical second series of courses having a second free-end that are joined by a connector. The method further provides turning the second series of courses outside of the first series of courses while the second series of courses is joined by held loops to the first series of courses at the connector. The method still further includes knitting the second free-end to the first free end using held loops from the second series of courses to form a completed two-ply garment.

DETAILED DESCRIPTION OF THE INVENTION

Figure 1:
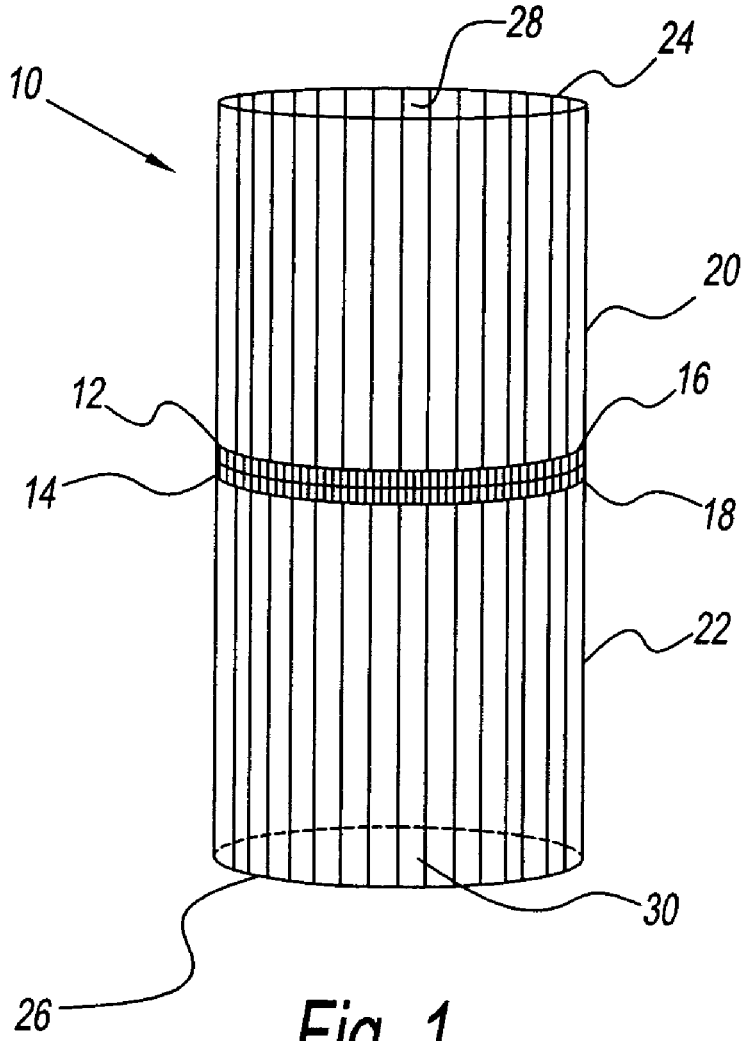
FIG. 1 is a perspective view of a first embodiment of a circularly knitted blank.

Referring to the drawings and, in particular FIG. 1, there is provided a circularly knitted blank according to a first embodiment of the present invention generally represented by reference numeral 10. Blank 10 is knitted in a generally cylindrical shape on a circular knitting machine. Blank 10 is illustrated in this embodiment as a brassiere blank. Blank 10 can be used for many types of brassieres, such as a bandeau, a sports brassiere or a traditional brassiere. Of course, blank 10 can be many other types of garments including, but not limited to, a pair of panty hose, a stocking, a blouse, a leotard, a swim suit, a pair of underwear, a pair of panties, and other garment items.

The blank 10 is preferably formed or knitted on a circular knitting machine. Preferably, the circular knitting machine has a computerized electronic needle and yarn feed selection system, such as circular knitting machine Model No. SM8-8, or SM8-8 top manufactured by Santoni or Brescia EVO4 circular knitting machine. Typically, cylindrical blanks, like blank 10, are knitted using both the cylinder needles and the dial needles. The cylinder needles knit a first series of courses, and the dial needles knit a second series of courses. In the present invention, the entire blank 10 is knitted only on the cylinder needles of a circular knitting machine. Specific loops are held by the cylinder needles and are reconnected at specific times to thus fold the blank such that it exits the machine as a completed single two-ply blank.

Figure 2:
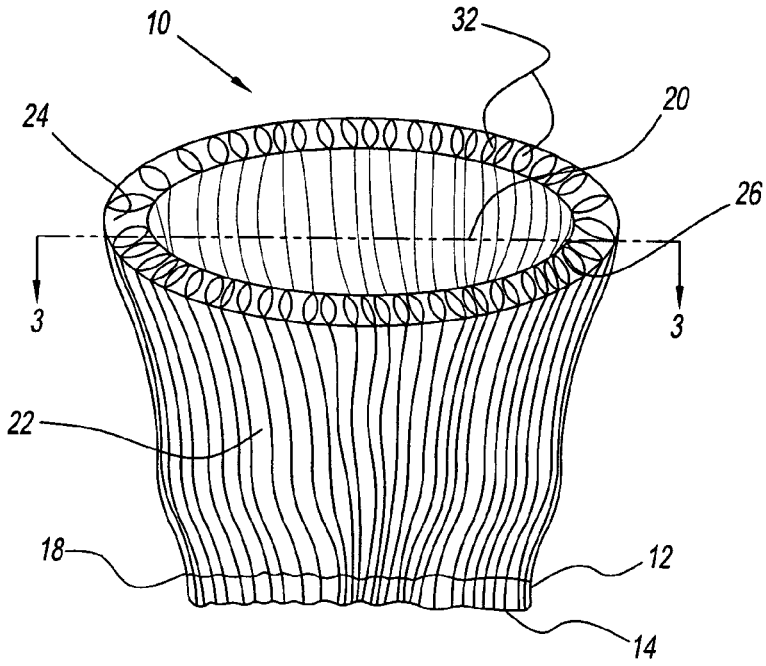
FIG. 2 is a perspective view of the blank of FIG. 1 that is folded inside itself.
Figure 3:
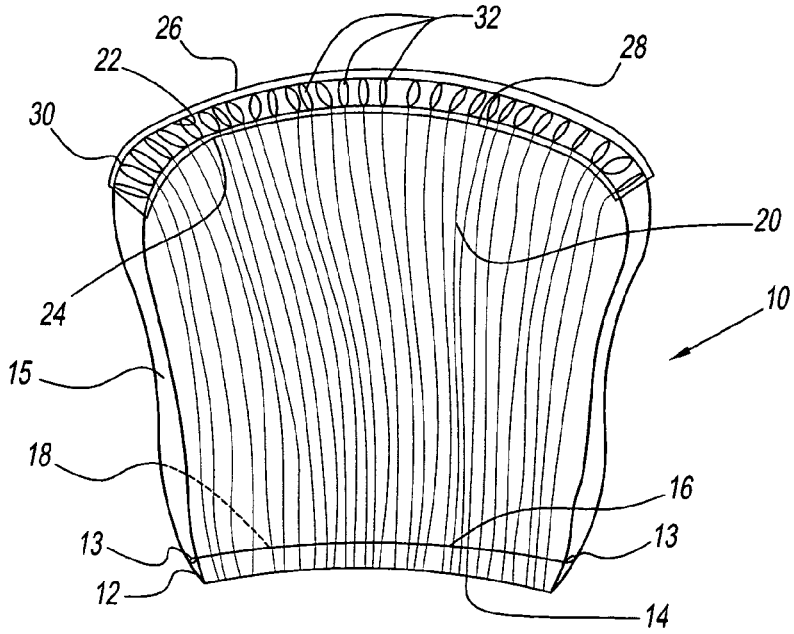
FIG. 3 is a cross-sectional view of the blank of FIG. 2.

Blank 10 includes a first course 20 and a second course 22 that are both seamlessly connected and preferably turned at a fold region 14. Referring to FIGS. 2 and 3, the fold region 14 is between a first stitch line and a second stitch line. Welt 12 has a first stitch line 16 and a second stitch line 18. First course 20 has a first free-end 28 and optionally a mini-turned welt 24 to prevent fraying at the edges of the first free-end. Second course 22 has a second free-end 30 and optionally a mini-turned welt 26 to prevent fraying at the edges of the second free-end 30. Before exiting a knitting machine, second course 22 will become an outer layer or ply, of blank 10 by being turned outside of first course 20 to form a two-ply blank, as shown in FIG. 2.

During the knitting process, first course 20 is first knitted with a stitch pattern, such as a rib stitch, that requires a held loop to be transferred at a later time during the knitting process. Then, welt 12, that functions as an anchoring chest band, is seamlessly knitted to first course 20. Referring to FIG. 3, halfway through knitting welt 12, the circular knitting machine turns welt 12 at fold region 14 and finishes knitting the second half of welt 12. For purposes of clarity, there is shown a gap 15 to indicate a slight separation between first course 20 and second course 22. After welt 12 is completed, the knitting machine transfers held loops 13 from second course 22 to first course 20, thereby forming stitch lines 16 and 18. Second course 22 is again joined to first course 20 by transferring a plurality of held loops 32, formed during the knitting process of second course 22, to complete blank 10. Optionally, first course 20 can be started using a mini turned welt 24 and second course 22 can be ended with a mini turned welt 26.

By transferring held loops 13 and 32 and connecting courses 20 and 22 during the knitting process, the manual step of turning the second course 22 outside of first course 20 is eliminated. Furthermore, relative movement between courses 20 and 22 is reduced and subsequent handling and finishing is expedited. Blank 10 exits the circular knitting machine as a completed blank such as that shown in FIG. 2.

The brassiere 10 can be formed of a single type of stitch pattern throughout the brassiere. For example brassiere 10 can be formed by a 1X1 turned welt (knit-miss). Alternatively, first course 20 can be formed of a looser ribbed knit to provide comfort and support to the wearer. Alternatively, first course 20 and second course 22 can be formed of, for example, a 3X1 (knit-miss) rib and welt 16 can be formed of a 1X1 (knit-miss) stitch to function as a chest band to provide a slightly firmer contact to the wearer than the first and second courses.

Figure 5:
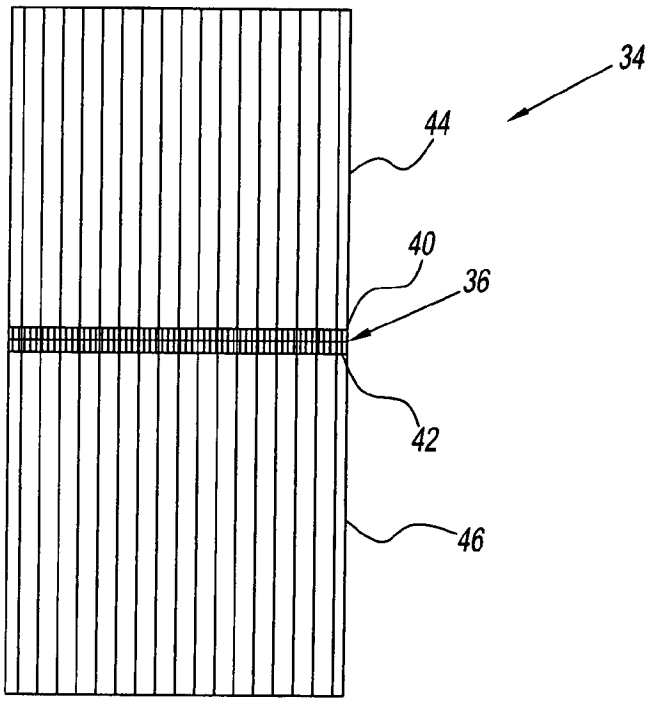
FIG. 5 is a back view of the blank of FIG. 4.
Figure 4:
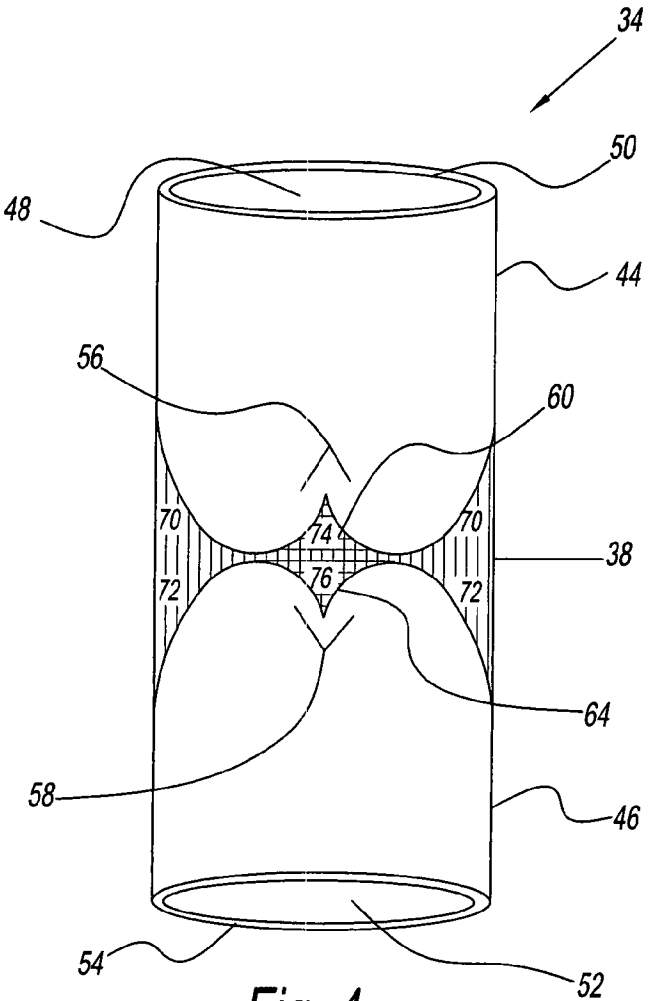
FIG. 4 is a perspective view of the front view of a second, preferred embodiment of a circularly knitted blank.

FIGS. 4 and 5 show the second preferred embodiment from the front and back of blank 34, respectively. Blank 34 includes a first course 44, a second course 46, and a welt 36 having a fold region 38. First course 44 has a free-end 48 and optionally a mini turned welt 50 to prevent fraying at the edges of free-end 48. Second course 46 has a free-end 52 and, optionally, a mini turned-welt 54 to prevent fraying at the edges of free-end 52. First course 44 and second course 46 each have a pair of breast cups 56 and 58, respectively. Breast cups 56 preferably have a peripheral edge 60. Likewise, breast cups 58 preferably have a peripheral edge 64. First course 44 preferably has a central gore 74 and lateral panels 70. Second course 46 preferably has central gore 76 and lateral panels 72.

The back of blank 34 incorporates stitch patterns necessary to its formation, such as a rib stitch pattern, as shown in FIG. 5. Also, back of blank 34 incorporates welt 36. The stitching of the back of brassiere blank 34 will be discussed further below.

The method of knitting two-ply blank 34 is accomplished by knitted only on the cylinder needles of a circular knitting machine. The computerized knitting machine is programmed to simultaneously knit blank 34 front and back. Different features may be knitted to add functionality to blank 34. At the front of blank 34, breast cups 56 and 58 are knitted with a plain or decorative stitch. Central gores 74 and 76 and lateral panels 70 and 72 are knitted in blank 34. As the front of blank 34 is knitted, the back of blank 34 is also knitted with a rib stitch or other such stitch that requires a held loop.

Figure 6:
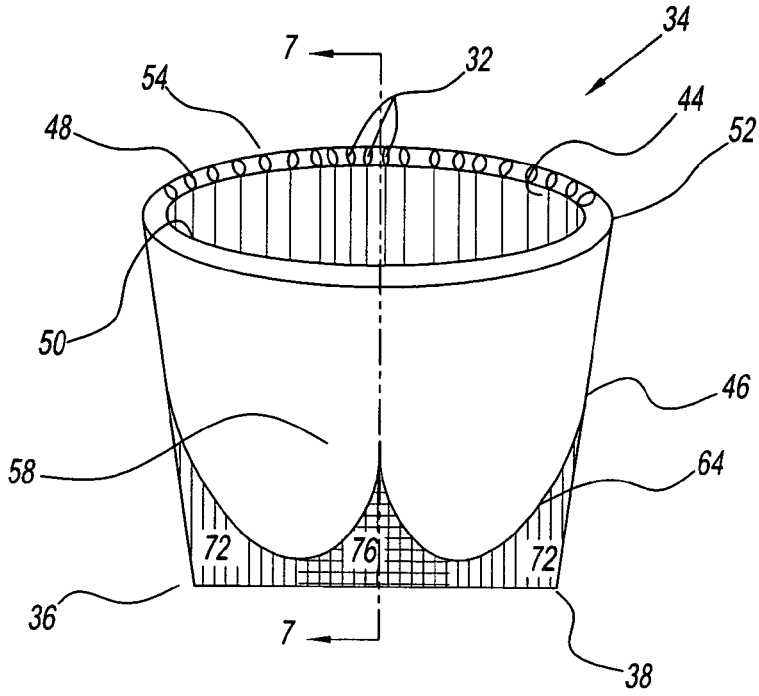
FIG. 6 is a perspective view of the circularly knitted blank of FIG. 4, that is folded inside itself.
Figure 7:
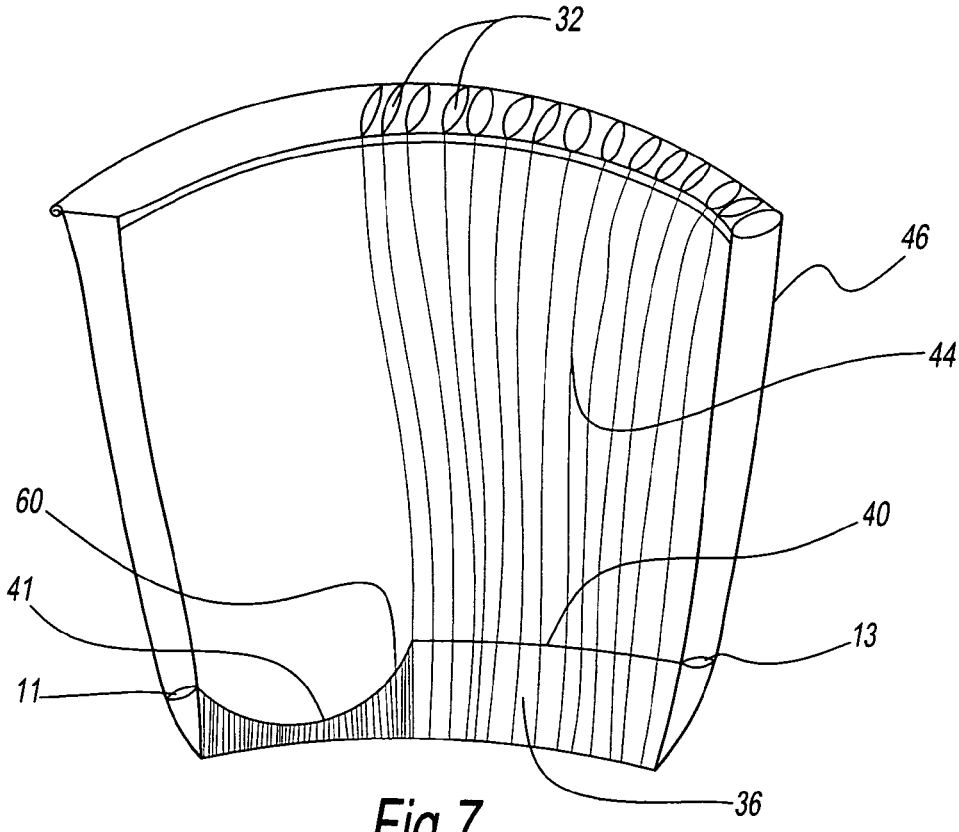
FIG. 7 is a sectional view of the blank of FIG. 6.

First course 44 is knitted and is seamlessly connected to welt 36 at the back of blank 34. Simultaneously, at the front of first course 44, breast cups 56, central gore 74 and lateral panels 70 are knitted before turning at fold region 38 to knit second course 46. The back of second course 46 is also seamlessly connected to welt 36 at the back of blank 34. At the front of second course 46, as breast cups 58, central gore 76 and lateral panels 72 are knitted, peripheral edge 64 is simultaneously connected to first course 44 at peripheral edges 60 of breast cups 56, to produce a turned blank as shown in FIGS. 6 and 7. Peripheral edge 64 is knitted to peripheral edge 60 of first course using tuck stitches 11 to create a desired breast cup. During the knitting process, tuck stitches 11 create an arcuate stitch line 41 as they connect second course 46 to first course 44 at the inside of blank 34. At the back of blank 34, a straight stitch line 40 results as loops 13 are transferred from second course 46 to first course 44.

Tuck stitches 11 around the breast cups 56 and 58 reduce the relative shifting and movement between first course 44 and second course 46, thus increasing ease of handling by an operator. Tuck stitches 11 completed during the knitting process also eliminate the manual turning step that an operator would traditionally perform. Like the transfer of held loops 13 to form stitch line 40, tuck stitches 11 are also transferred from second course 46 to first course 44 during the knitting process thereby turning second course 46 outside of first course 44. The automatic transfer of held loops and from second course 46 to first course creates a process that is more efficient by decreasing production costs. Held loops 32 are only present at the back of blank 34 because the front of blank 34 is knitted with a more decorative stitch appropriate for breast cups. Optionally, first course 44 can be started with a mini-turned welt 50 and second course 46 can be ended with a mini-turned welt 54, to prevent fraying.

In FIGS. 6 and 7, the back of brassiere blank 34 is knitted with a rib stitch. The back of brassiere blank 34 must be knitted using a rib stitch or a welt stitch because held loops 32 must be transferred from second course 46 to first course 44 to create the completed blank before blank 34 exits the knitting machine. Additionally, in the preferred embodiment, the held loops 32, that connect second course 46 to first course 44 preferably include at least four threads per loop for added strength.

The preferred embodiment of brassiere blank 34 has several different areas that can incorporate different stitches to provide additional functionality to the completed garment. The breast cups 56 and 58 can be formed using a jersey knit stitch. The breast cups can be knitted to incorporate a plain appearance or, optionally, may have unique aesthetic and recognizable knitted-in characteristics including, but not limited to, a Jacquard pattern design, geometric, stylized logo, abstract, or other designs or patterns such as florals.

Referring to FIG. 4, central gore areas 74 and 76 are knitted using a waffle stitch of a 1X1 (knit-miss) in the wale direction and 3X1 (knit-miss) in the course direction. A waffle stitch would provide the necessary support and comfort, although other stitch patterns providing similar qualities could be used. Lateral panels 70 and 72, are preferably formed using a rib stitch to provide a close contact to the body of the wearer.

The brassiere blank 34 is ready for further manufacturing steps, such as dyeing, finishing, and/or boarding to form a single double layer circular knit brassiere. The manufacturing steps may be completed with the brassiere blank 34 fully assembled, upon exiting the circular knitting machine.

First course 44 is made of a material suitable for an inner layer of a brassiere, preferably yarns selected for softness, comfort and wicking properties. First course 44 is preferably made of either with textured continuous filament yarns from synthetic fibers having a relatively high number of fine denier filaments or a microfiber having about 20 to about 120 denier or staple yarn produced from natural or synthetic fibers or a blend of both in the in the size range of about 40/1 s to about 70/1 s cotton count. Such yarn provides softness, comfort and desired moisture wicking properties. The wicking properties would be particularly important were the garment manufactured as a sports brassiere. Additionally, first course 44 can be made using an elastomeric stretch yarn, such as spandex, in combination with nylon or cotton non-stretch yarns.

Second course 46 is made of a material suitable for an outer layer of a brassiere. Second course 46 may include the same or different yarn combinations and constructions as first course 44. Second course 46 is preferably made of synthetic continuous multifilament flat or textured polymer or spun yarn. Second course 46 preferably also has an elastomeric yarn, such as bare spandex or spandex, that is covered with a textured multifilament synthetic fiber yarn. The combination of yarns from a fabric that may contain a staple yarn produced from natural or synthetic fibers or a blend of both, in a size range of about 40/1's to about 70/1's count or synthetic continuous multifilament flat or textured yarn, such as nylon, in a range between 10 to about 200 denier, and preferably from about 60 to about 120 denier.

Figure 8:
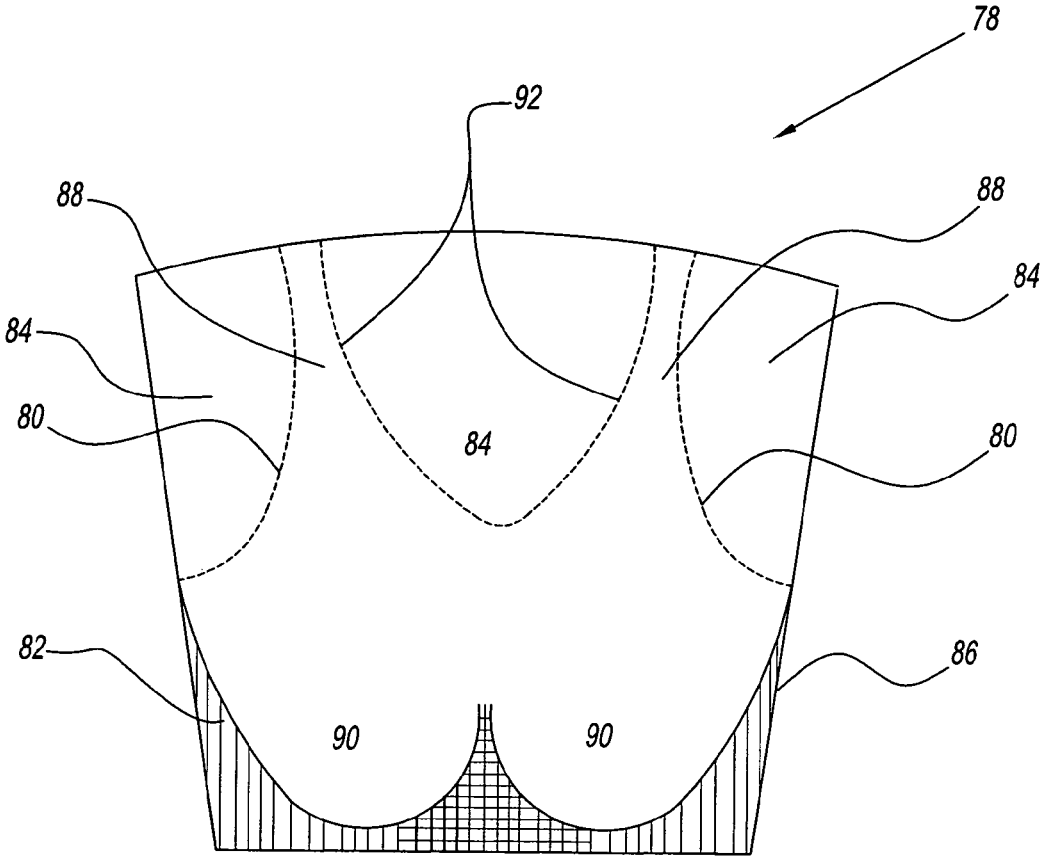
FIG. 8 is a front view of the blank of FIG. 4, that is folded inside itself.

Referring now to FIG. 8, blank 78 includes patterning shown as a plurality of lines 80 and 92 that define the breast cups 90 and straps 88, respectively. Lines 80 and 92 define removable sections 84 to define neck holes and armholes of blank 78. The patterning on the blank 78 is dependent on the style of the resultant brassiere. For example, the blank 78 could have different patterning for a sports brassiere or minimal patterning for a bandeau or a strapless brassiere. Arm holes and neck holes are finished in a manner known in the art.

While the present invention has been described with reference to one or more exemplary embodiments, it will be understood that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

What is claimed is:

1. A circularly knitted garment comprising:

a first series of courses having a first free-end, a third end, and having a first end and a second series of courses having a second free-end, a fourth end, and having a second end wherein said first end and said second end form a connection, and wherein said second end is integrally connected to said first end and said second free-end is integrally connected to said first free-end to form a two-ply garment without the first and second courses needing to be turned outside one another.

2. The garment according to claim 1, wherein said connection is a welt.

3. The garment according to claim 1, wherein said third free end and said fourth end are turned welts.

4. The garment according to claim 1, wherein said first series of courses and said second series of courses are knitted using a stitch that requires a plurality of held loops and said second series of courses is connected to said first series of courses by transferring said plurality of held loops.

5. The garment according to claim 1, wherein said garment is a brassiere.

6. The garment according to claim 1, wherein said garment is selected from the groups consisting of a brassiere, a pair of panty hose, a stocking, a leotard, a swimsuit, a pair of underwear and a pair of panties.

7. A circularly knitted two-ply garment comprising:

a first series of courses having a first free-end, a first front side, a first pair of breast cups, said first pair of breast cups having a first periphery, and a first back side having a welt; and a second series of courses having a second free-end, a second front side, a second pair of breast cups, said second pair of breast cups having a second periphery, and a second back side having said welt;

wherein said first series is integrally connected to said second series at said welt, said second periphery is integrally connected to said first periphery and said second free-end is integrally connected to said first free-end to form a two-ply garment.

8. A circularly knitted garment comprising:

a first layer of fabric having a first free-end and a second end; and a second layer of fabric having a second free-end and a third end, said second layer connected to said second end by a junction at said third end and by a plurality of integrally formed loops extending from said second free-end to form a completed two-ply garment.

9. The garment according to claim 8, wherein each of said plurality of loops comprise a single strand of thread.

10. The garment according to claim 8, wherein each of said plurality of loops comprise multiple strands of thread.

11. The garment according to claim 8, wherein said junction has a first end and a second end that are connected.

12. The garment according to claim 8, wherein said first layer and said second layer and said junction are knit using a using a rib stitch.

13. The garment according to claim 8, wherein the garment is selected from the group consisting of a brassiere, a pair of panty hose, a stocking, a leotard, a swimsuit, a pair of underwear and a pair of panties.

14. The garment according to claim 8, wherein the garment is a brassiere.

15. A circular knit garment comprising:

a first series of courses having a first-free end comprising an inner layer;

a second series of courses having a second free-end comprising an outer layer;

a junction connecting said first series to said second series; and a plurality of integrally formed loops connecting said second free-end to said first free-end to form a completed garment.

16. The garment according to claim 15, wherein said first series of courses has a first front side and said second series of courses has a second front side and said first series of courses has a first back side and said second series of courses has a second back side.

17. The garment according to claim 15, wherein said first front side comprises a first pair of breast cups knitted therein comprising a first lower arcuate border and said second front side comprises a second pair of breast cups knitted therein comprising a second lower arcuate border integrally connected to said first border.

18. The garment according to claim 17, wherein said first lower arcuate border comprises a first medial portion and first lateral portions and said second lower arcuate border comprises a second medial portion and second lateral portions.

19. The garment according to claim 18, wherein said first front side further comprises a first central gore proximate said first medial portion and first support panels proximate said first lateral portion and said second front side further comprises a second central gore proximate said second medial portion and first support panels proximate said second lateral portions.

20. The garment according to claim 15, wherein said inner layer is knitted using a wicking yarn.

21. The garment according to claim 15, wherein said outer layer is selecting from the group consisting of natural fiber, spandex, synthetic continuous multifilament flat or textured polymer yarn, staple yarn, and any combination thereof.

22. The garment according to claim 15, wherein the garment is selected from the group consisting of a brassiere, a pair of panty hose, a stocking, a leotard, a swimsuit, a pair of underwear and a pair of panties.

23. A method of making a garment blank comprising:

knitting a generally cylindrical first series of courses having a first free-end;

knitting a generally cylindrical second series of courses having a second free-end;

knitting a junction to seamlessly connect said first series to said second series;

turning said second series outside of said first series about said junction; and knitting said second free end to said first free end at a plurality of locations using threads from said second series of courses to form a completed two-ply garment.

24. The method according to claim 23, further comprising knitting said first series of courses and said second series of courses on a first side to form a first pair of breast cups and a second pair of breast cups, respectively, that overlay each other in registration when said second series is turned outside of said first series.

25. The method according to claim 24, further comprising knitting a portion of said second pair of breast cups to said first pair of breast cups before said garment is completed.

26. The method according to claim 24, wherein said step of knitting said second free-end to said first free-end comprises transferring held loops from said second free-end to said first free-end.

27. The method according to claim 23, wherein said step of knitting said junction comprises knitting a turned welt.

28. The method according to claim 23, wherein after said step of turning said second series outside of said first series further comprises knitting a portion of said junction to itself.

29. A method according to claim 23, wherein said steps of knitting said first series of courses, said second series of courses and said junction further comprise knitting a turned welt.

30. The garment according to claim 23, wherein said garment is selected from the group consisting of a brassiere, a pair of panty hose, a stocking, a leotard, a swimsuit, a pair of underwear and a pair of panties.

31. The garment according to claim 8, wherein said junction is a welt.

* * * * *